United States Patent [19]

Prahs

[11] Patent Number: 4,461,403

[45] Date of Patent: Jul. 24, 1984

[54] STRIPING DISPENSER

[75] Inventor: Harald Prahs, Hamburg-Wentorf, Fed. Rep. of Germany

[73] Assignee: Colgate-Palmolive Company, New York, N.Y.

[21] Appl. No.: 329,170

[22] Filed: Dec. 10, 1981

[30] Foreign Application Priority Data

Dec. 17, 1980 [DE] Fed. Rep. of Germany ..... 8033450

[51] Int. Cl.[3] ..... B67D 5/56

[52] U.S. Cl. ..... 222/129; 222/94; 222/391

[58] Field of Search ..... 222/386, 391, 409, 129, 222/132, 136, 145, 485, 482, 478, 94, 92

[56] References Cited

U.S. PATENT DOCUMENTS

| | | | |
|---|---|---|---|
| 2,789,731 | 4/1957 | Marrassino | 222/129 |
| 2,959,327 | 11/1960 | Bloom | 222/94 |
| 3,255,935 | 6/1966 | Spatz | 222/391 |
| 3,506,157 | 4/1970 | Dukess | 222/94 |

*Primary Examiner*—Joseph J. Rolla
*Assistant Examiner*—Kenneth Noland
*Attorney, Agent, or Firm*—Herbert S. Sylvester; Murray M. Grill; John A. Stemwedel

[57] ABSTRACT

A dispenser for extruding a major portion of a first pasty material and a minor portion of a second pasty material which comprises an elongated tubular container forming a first product containing chamber opened at one end to receive a product dispensing piston and closed at the other end with a delivery head including a product delivery channel arranged parallel to the longitudinal axis of the dispenser and communicating the contents of the first product containing chamber to a discharge port, a second product containing chamber which is open at one end to the first product containing chamber and which has a connecting orifice which connects the second product containing chamber to the product delivery channel, and bearing surfaces adapted to accept a piston drawing assembly, a product dispensing piston transversely disposed in the elongated tubular container including a stop spring to restrain outward motion of the piston, and a piston drawing assembly including a shaft adapted to engage the piston stop spring and an actuator to impart reciprocal motion to the shaft.

4 Claims, 3 Drawing Figures

STRIPING DISPENSER

Figure 1:
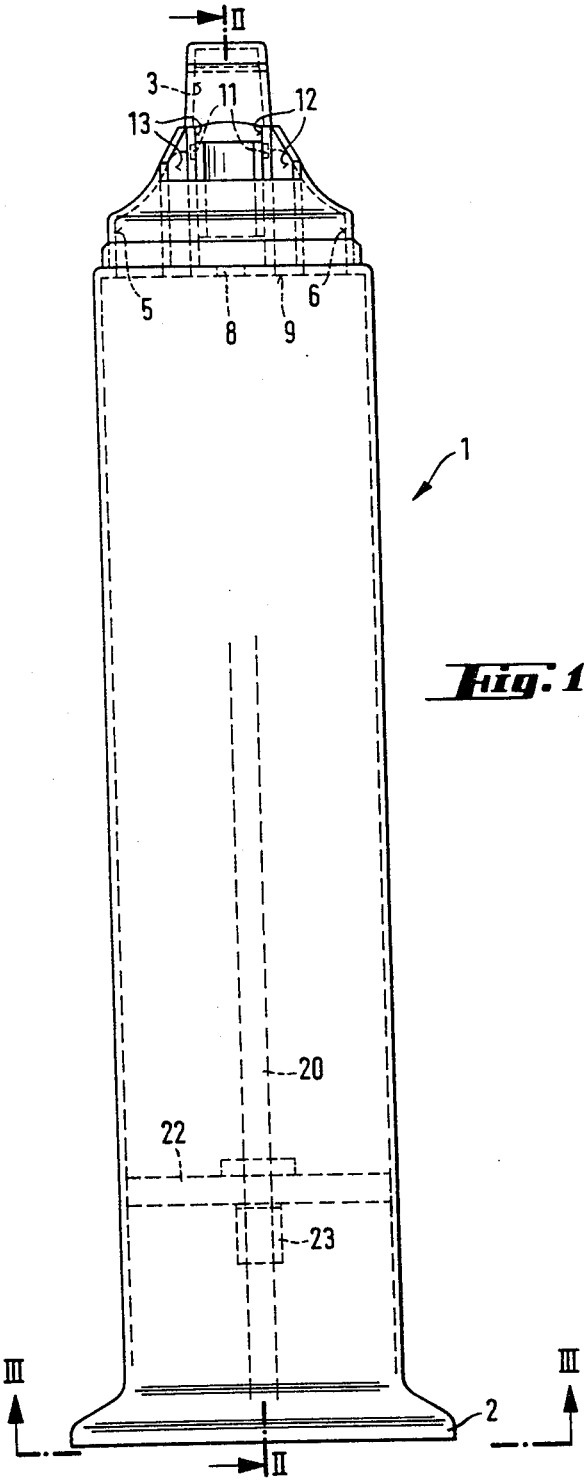

The invention relates to a dispenser for dispensing two pasty materials from a discharge port of a tubular container by the inwardly drawn action of a product dispensing piston.

A dispenser for pasty products is described in U.S. Pat. No. 2,789,731 in which a hollow cylindrical container is provided with a piston which may be displaced toward the delivery end of the container by means of forcing a handle connected to the piston and projecting from the opposite end of the container. In the delivery end of this dispenser, an annular insert is provided having a hollow discharge tube and striping grooves through the periphery of the annular insert. The annular insert may be filled with a pasty material of a different color from that contained in the remainder of the container, so that upon displacing the piston towards the delivery end, the main pasty material is forced out of the container through the discharge tube and at the same time the second striping material in the annular insert is forced by the first pasty material to move through the striping grooves into the body of the other pasty material being extruded from the discharge tube giving it a striped appearance.

Such annular insert in a striping dispenser cannot be used for a dispenser having an eccentrically positioned delivery channel and a piston drawing means located in the vicinity of the delivery end. It is an object of the invention to provide a dispenser for a striped pasty material which will not be subject to one or more of the above disadvantages. Other objects and advantages will appear as the description proceeds.

According to one aspect of the present invention, a dispenser for extruding a major portion of a first pasty material and a minor portion of a second pasty material is provided which comprises a elongated tubular container forming a first product containing chamber opened at one end to receive a product dispensing piston and closed at the other end with a delivery head including a product delivery channel arranged parallel to the longitudinal axis of the dispenser and communicating the contents of the first product containing chamber to a discharge port, a second product containing chamber which is open at one end to the first product containing chamber which is open at one end to the first product containing chamber and which has a connecting orifice which connects the second product containing chamber to the product delivery channel, and means adapted to accept a piston drawing means, a product dispensing piston transversely disposed in the elongated tubular container including a stop means to restrain outward motion of the piston, and a piston drawing means including a shaft adapted to engage the piston stop means and an actuator to impart reciprocal motion to the shaft.

The container according to the invention uses specially shaped chamber which makes it possible to press a thin stripe of a different colored pasty material into the main stream of pasty material extruded from that in the remainder of the container in spite of the fact that the discharge port is offset from the containers longitudinal axis.

The chamber may have two or more main areas connected by a connecting area running between a delivery channel wall and an holding area wall in order to obtain a continuous chamber of maximum size. The connecting area may communicate with the delivery channel by means of a connecting orifice.

For ease of manufacture of the complete container, the shaped chamber may be of unitary construction with the delivery end of the container, and in fact the elongated tubular container will usually be formed as one piece.

Figure 2:
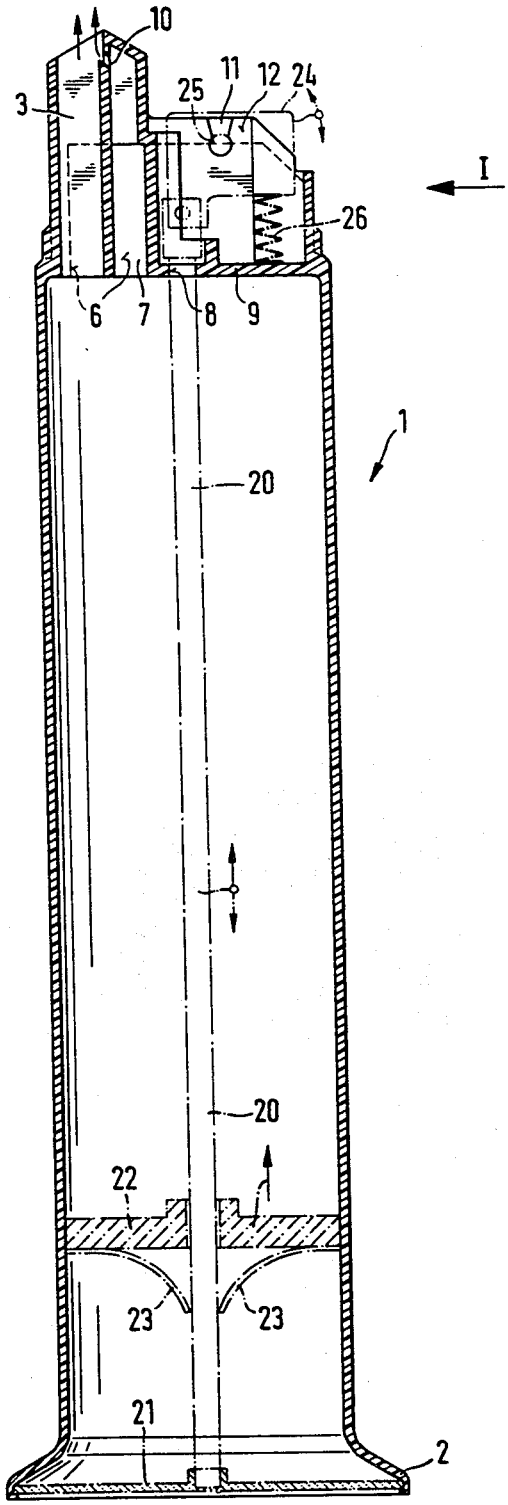
Figure 3:
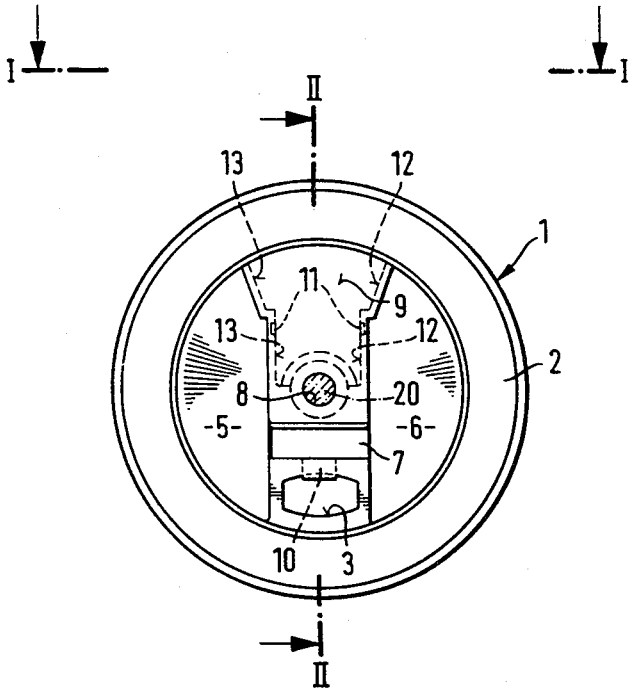

The structure of the device of the invention will be described in connection with the accompanying drawings wherein FIG. 1 is a front elevation of a dispensing container for pasty materials, FIG. 2 is a sectional view along line II—II of FIG. 1, showing, in phantom form, the base, the piston, the drawing shaft and the actuating member of the dispenser, and FIG. 3 is a bottom plan view of the container for the dispenser shown in FIG. 1.

The container 1 is tubular and has at its lower end a flange 2 to form a circular base. At the upper or delivery of container 1, a principle delivery channel 3 is provided which is parallel to the longitudinal axis of the container, but which is displaced towards the periphery of the dispensing end. Opposite the delivery channel 3 vertical walls 12 and 13 are provided containing bearing openings (only the bearing opening 11 of wall 12 is shown), adpated to permit the insertion of a bearing pin whose function will be described hereinafter.

As is most particularly visible from FIG. 3, the area between walls 12 and 13 is closed by a wall 9 through which extends an opening 8. The wall 9 is in the plane in which the lower end of the delivery channel 3 leads from the body of the container. The remaining cross-sectional surface of the container 1 located in the plane of wall 9 is open towards flange 2, part of the cross-section being taken up by the cross-sectional surface of delivery channel 3. The remainder being formed by a main area 5, a main area 6 and a connecting area 7 which constitutes a continuous space which is substantially closed at the top (FIG. 2), i.e. only the connecting area 7 is connected by a connecting orifice 10 with the delivery channel 3. As shown in FIG. 2, the area where connecting orifice 10 enters the delivery channel 3 is displaced somewhat with respect to the underlying wall portion, so that material discharged from the orifice 10 need not be pressed into the material stream discharged from delivery channel 3. Instead, a corresponding free space is formed in the material stream for the entry of the pasty material through the orifice 10.

FIG. 2 shows the construction of the complete dispenser showing, in phantom form, a bottom base 21, a piston 22, a stop spring or spider 23, all placed on a drawing shaft 20 and an actuating member 24. The drawing shaft 20 extends through the opening 8 ad is connected by means of a wrist pin 25 with the actuating member 24, which is held by a bearing pin (not shown) extending through the bearing opening 11 in wall 12 and the corresponding bearing opening in wall 13. A spring 26 bears on the wall 9 and presses the actuating member 24 into the represented position.

In order to press the material out of the delivery channel 3, and a differently colored pasty material from main areas 5 and 6 and connecting area 7, the right-hand end of the actuating member 24 is pivoted downwards and consequently the drawing shaft 20 is moved upwardly in FIG. 2. Due to the indexing action of the stop spring or spider 23, this movement, the piston 22 is also moved upwardly and presses the pasty material in the container out of the delivery channel 3. Due to the resulting pressure, the differently colored material is pressed out of the main areas 5 and 6 and the connecting area 7 through the connecting orifice 10, being added to the pasty material stream moving through the delivery channel 3.

Upon releasing the actuating member 23, the drawing shaft 20 moves downwards into the relaxation of the spring 26, while the piston 22 remains in the position reached, because the drawing shaft 20 slides with virtually no resistance between the stop spring or spider 23 going downwardly in order to reach the represented position.

The container may be manufactured from plastic material and can be produced in one piece by injection molding.

The dispenser may be filled with toothpaste. For example, using essentially connential equipment with either one or two filling nozzles. In the case of single-nozzle equipment the specially shaped chamber is filled in the first operation and the dispenser is moved to the next filling station to be completely filled with the main product. Where the filling apparatus has two filling nozzle per filling station, the pasty material are sequentially filled before insertion of the piston and final packaging.

What is claimed is:

1. A dispenser for extruding a major portion of a first pasty material and a minor portion of a second pasty material which comprises an elongated tubular container forming a first product containing chamber opened at one end to receive a product dispensing piston and closed at the other end with a delivery head including a product delivery channel arranged parallel to the longitudinal axis of the dispenser and communicating the contents of the first product containing chamber to a discharge port, said delivery head also includes a second product containing chamber which is open at one end to the first product containing chamber and which has a connecting orifice which connects the second product containing chamber to the product delivery channel, and means adapted to accept a piston drawing means, said product dispensing piston transversely disposed in the elongated tubular container including a stop means to restrain downward motion of the piston, and said piston drawing means including a shaft adapted to engage the piston stop means and an actuator to impart reciprocal motion to the shaft, and said second product containing chamber is displaced towards the periphery of the dispensing end to partially surround said piston drawing means.

2. The dispenser according to claim 1 wherein the second product containing chamber includes two main areas and a connecting area.

3. The dispenser according to claims 1 or 2 wherein the elongated tubular container is constructed in one piece.

4. The dispenser according to claim 2 wherein the connecting orifice is located in the connecting area of the second product containing chamber.

* * * * *